US007117568B2

(12) United States Patent
Nolan

(10) Patent No.: US 7,117,568 B2
(45) Date of Patent: Oct. 10, 2006

(54) BUCKLE ASSEMBLY

(75) Inventor: Patrick Nolan, Royersford, PA (US)

(73) Assignee: Graco Children's Products Inc., Exton, PA (US)

( * ) Notice: Subject to any disclaimer, the term of this patent is extended or adjusted under 35 U.S.C. 154(b) by 0 days.

(21) Appl. No.: 10/735,817

(22) Filed: Dec. 16, 2003

(65) Prior Publication Data

US 2005/0125970 A1 Jun. 16, 2005

(51) Int. Cl.
*A44B 11/26* (2006.01)

(52) U.S. Cl. ..... 24/579.11; 24/632

(58) Field of Classification Search ..... 24/630–632, 24/614–616, 579.11, 625; 297/483, 484; 280/808

See application file for complete search history.

(56) References Cited

U.S. PATENT DOCUMENTS 3,542,426 A * 11/1970 Radke ..... 24/579.11
4,704,771 A * 11/1987 Orje ..... 24/579.11
6,049,954 A 4/2000 Britto
6,226,844 B1 * 5/2001 Lerra et al. ..... 24/625
6,393,677 B1 * 5/2002 Anscher ..... 24/630
6,543,101 B1 4/2003 Sack et al.

FOREIGN PATENT DOCUMENTS

GB 2286851 A * 8/1995

OTHER PUBLICATIONS

Photographs of Century Five Point Buckle, 5 pp., Century Products.
Photographs of Peg Perego Five Point Buckle, 5 pp., Peg Perego.

* cited by examiner

*Primary Examiner*—James R. Brittain
(74) *Attorney, Agent, or Firm*—Lempia IP Group, LLC

(57) ABSTRACT

A buckle assembly is described. The buckle assembly includes a a buckle body having first and second openings, and first and second waist strap fasteners, each having a fastener coupling section configured to couple to the respective openings of the buckle body, each also having a shoulder strap coupling section. The buckle assembly also includes first and second shoulder strap fasteners, each having a waist strap fastener coupling section configured for coupling to the shoulder strap coupling section of the respective waist strap fastener, wherein the respective shoulder strap coupling sections and the respective waist strap coupling sections are arranged relative to each other such that, when the first and second shoulder strap fasteners are coupled to the first and second waist strap fasteners, respectively, and the buckle body is coupled to the first and second waist strap fasteners, the first and second should strap fasteners are spaced from the respective openings of the buckle body and remain exterior of the buckle body.

11 Claims, 3 Drawing Sheets

BUCKLE ASSEMBLY

FIELD OF THE INVENTION

This invention relates to a buckle assembly. More specifically, this invention relates to a five point buckle assembly that can function as a three point buckle assembly or a five point buckle assembly.

BACKGROUND OF THE INVENTION

Five point buckle assemblies, which engage five straps, are known. For example, five point buckle assemblies for a car seat typically engage two shoulder harness straps, two waist harness straps, and a single bottom harness strap to restrain a child within the car seat. When a child is in the car seat and the buckle assembly components are coupled together, the shoulder, waist, and bottom harness straps act to restrain the child. These five point buckle assemblies thus accordingly comprise two shoulder strap fasteners, two waist strap fasteners, and a bottom strap fastener, which typically comprises a buckle body.

Five point buckles generally are of two types: 1) five point only, where the shoulder strap and waist strap fasteners are a single piece that cannot be separated, and 2) three/five point buckles that enable manual separation of the shoulder strap fasteners from the waste strap fastener or bottom strap fastener. Typically the shoulder strap fastener remains attached to the waist strap fastener even when the waist strap fastener is decoupled from the bottom strap fastener.

There is a need in the art for a five point buckle assembly where, when the waist strap fasteners are decoupled from the bottom strap fastener, the shoulder strap fasteners can decouple passively from the bottom strap fastener and need not be manually decoupled from the waist strap fasteners.

SUMMARY OF THE INVENTION

One aspect of the invention relates to a buckle assembly that includes a buckle body having first and second openings; first and second waist strap fasteners having first and second fastener coupling sections, respectively, configured for respectively coupling with the first and second openings, and having respective top coupling sections; and first and second shoulder strap fasteners having respective bottom coupling sections configured for coupling to respective of the top coupling sections to respectively couple the first waist strap fastener to the first shoulder strap fastener and the second waist strap fastener to the second shoulder strap fastener.

Another aspect of the invention relates to a buckle assembly that includes a buckle body having first and second openings; first and second waist strap fasteners, each having a fastener coupling section configured to couple to the respective openings of the buckle body, each also having a shoulder strap coupling section; and first and second shoulder strap fasteners, each having a waist strap fastener coupling section configured for coupling to the shoulder strap coupling section of the respective waist strap fastener, wherein the respective shoulder strap coupling sections and the respective waist strap coupling sections are arranged relative to each other such that, when the first and second shoulder strap fasteners are coupled to the first and second waist strap fasteners, respectively, and the buckle body is coupled to the first and second waist strap fasteners, the first and second should strap fasteners are spaced from the respective openings of the buckle body and remain exterior of the buckle body.

Yet another aspect of the invention relates to a buckle assembly that includes a buckle body having first and second openings; first and second waist strap fasteners, each having a fastener coupling section configured to couple to the respective openings of the buckle body, each also having a shoulder strap coupling section; and first and second shoulder strap fasteners, each having a waist strap fastener coupling section configured for coupling to the shoulder strap coupling section of the respective waist strap fastener, wherein, when the first and second waist strap fasteners are decoupled from the buckle body, the first and second shoulder strap fasteners passively decouple from the first and second waist strap fasteners, respectively.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and, together with the description, serve to explain the principles of the invention.

DETAILED DESCRIPTION OF THE PREFERRED EMBODIMENTS

Reference will now be made in detail to presently preferred embodiments of the invention, examples of which are illustrated in the accompanying drawings. An effort has been made to use the same reference numbers throughout the drawings to refer to the same or like parts.

Figure 1:
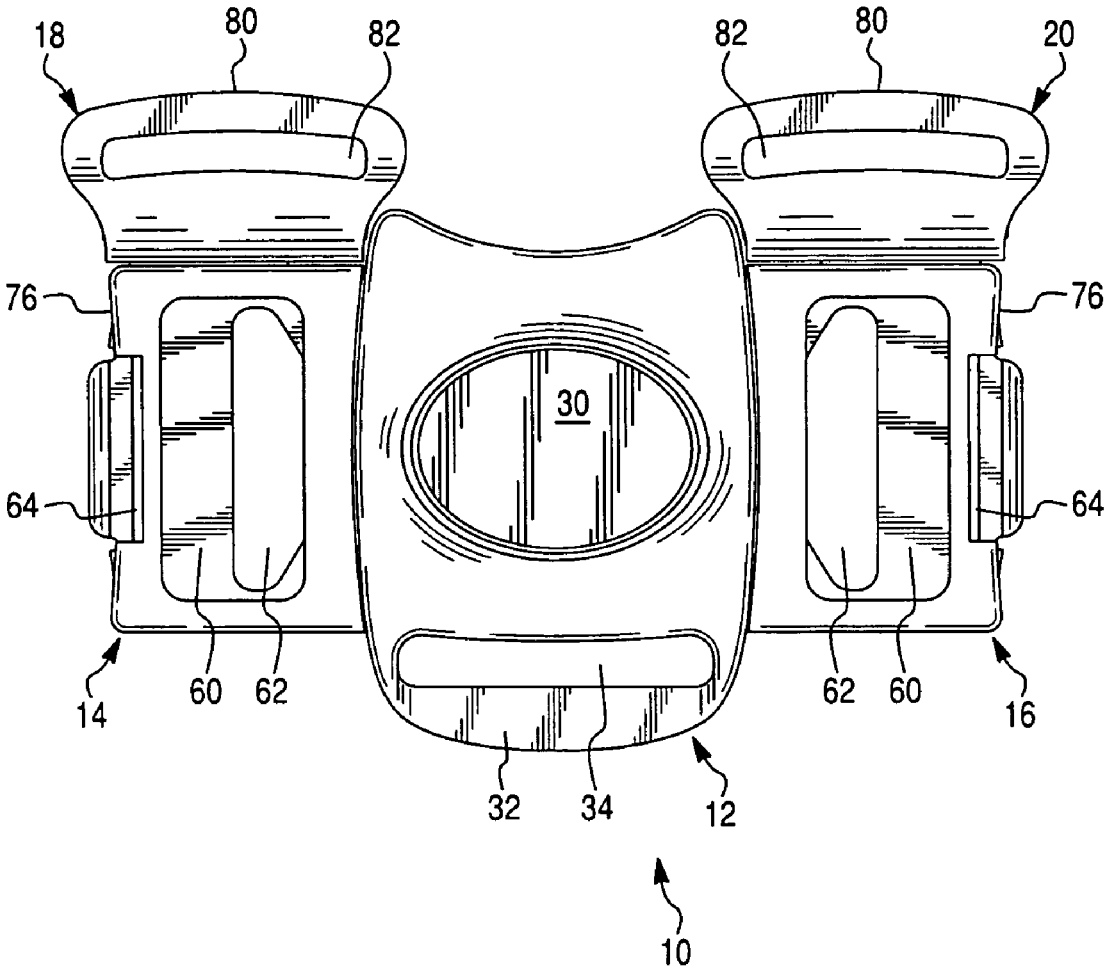
FIG. 1 is a front view that illustrates a buckle assembly in assembled form according to an embodiment of the invention.

FIG. 1 illustrates a buckle assembly 10 of a simple and robust design according to an embodiment of the invention. This buckle assembly 10 may be employed in five point harness systems designed to hold a child securely in a child product, such as a swing, a high chair, a bouncer, or a car seat. The buckle assembly 10 may also be used in any other context that requires a five point harness system. In FIG. 1, the buckle assembly is illustrated in an assembled configuration. The buckle assembly 10 generally includes five components, namely a buckle body 12, a first waist strap fastener 14, a second waist strap fastener 16, a first shoulder strap fastener 18, and a second shoulder strap fastener 20. The buckle assembly 10 may be made from acetal material, or materials such as nylon or polypropylene, for example.

Each of the components is configured to engage a respective harness strap (not shown). In this regard, the buckle body 12 includes a strap bar 32 and a strap opening 34. A bottom harness strap (not shown) may be passed through the strap opening 34 and may engage the strap bar 32.

Figure 7:
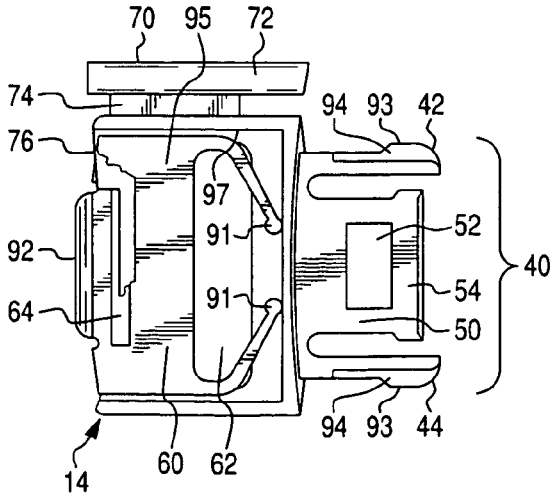
FIG. 7 is a front partial cut away view of the waist strap fastener of FIG. 6.

As best seen in FIGS. 1 and 7, each of the waist strap fasteners 14, 16 includes strap openings 62, 64 and a strap bar 60. A waist harness strap (not shown) may be passed through the strap openings 62, 64 and may engage the strap bar 60. The first and second waist strap fasteners 14, 16 include an inner strap coupling section 95 with spring member 91 that biases the inner strap coupling section 95 in a direction away from the buckle body 12 in a channel 97 of the waist strap fastener 14, 16. When attaching a harness strap to the strap bar 60, a button 92 is pushed, driving the inner strap coupling section 95 within the channel 97 such that both strap openings 62, 64 are exposed within a window 96. A strap is then passed through both the strap openings 62 and 64, and the button 92 may then be released, upon which the spring member 91 biases the bar 60 against the strap to aid in holding the strap securely in the waist strap fastener 14, 16. The strap can be adjusted relative to the waist strap fastener 14, 16 by pushing button 92 to expose the opening 64.

Returning to FIG. 1, each of shoulder strap fastener 18, 20 includes a strap bar 80 and a strap opening 82. A shoulder harness strap (not shown) may be passed through the strap opening 80 and may engage the strap bar 82.

Figure 2:
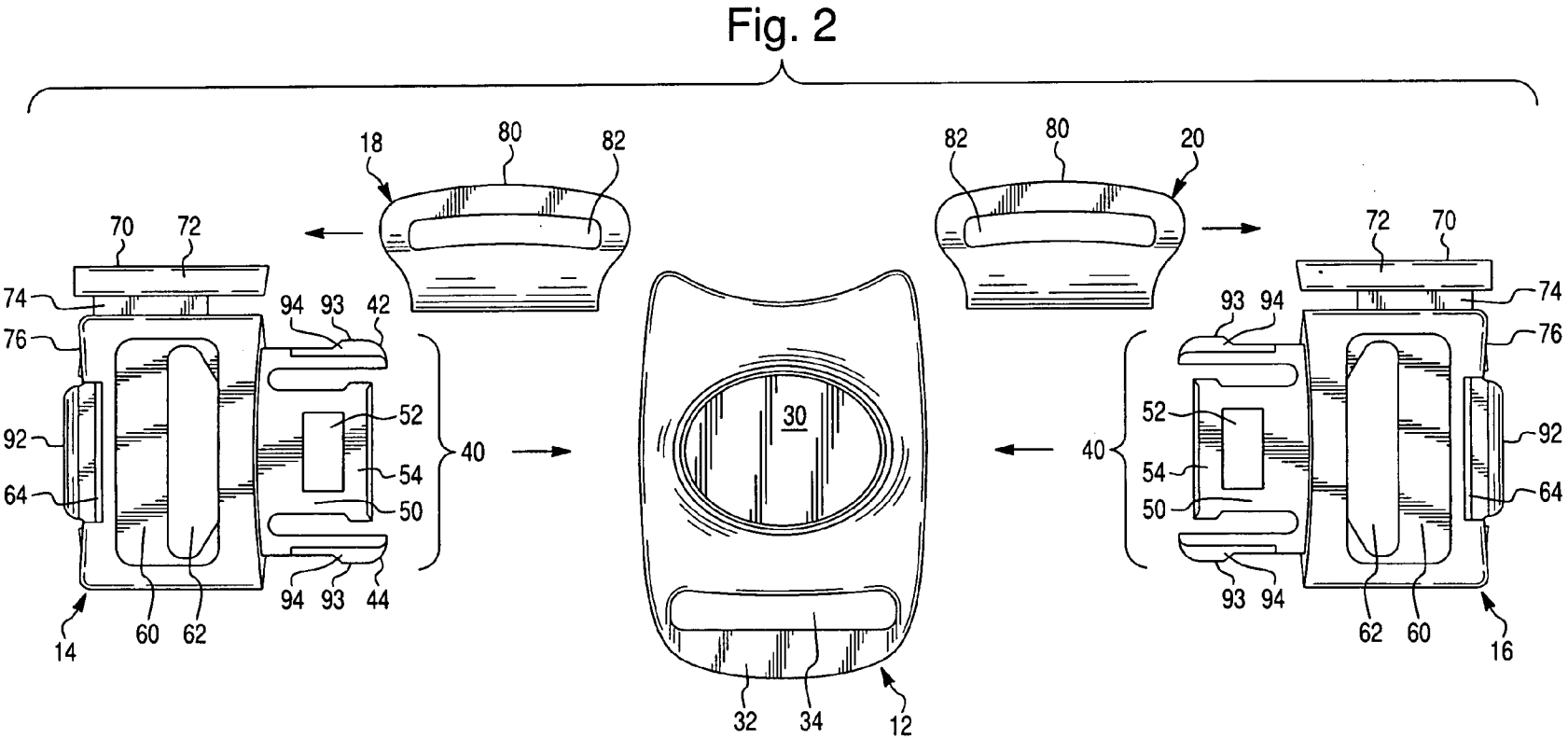
FIG. 2 is a front exploded view of the buckle assembly of FIG. 1.

The structures for coupling and decoupling of the components of the buckle assembly of FIG. 1 are now described with respect to FIGS. 2–7, where FIG. 2 illustrates the buckle assembly of FIG. 1 in an unassembled configuration, and FIGS. 3–7 illustrate components of the buckle assembly.

Figure 3:
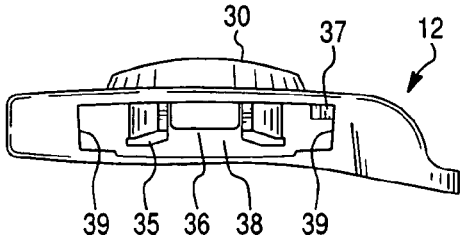
FIG. 3 is a side view illustrating a buckle body of the buckle assembly of FIGS. 1 and 2.
Figure 4:
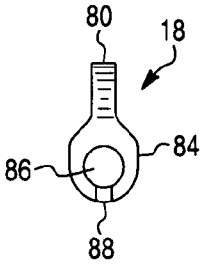
FIG. 4 is a side view of a shoulder strap fastener of the buckle assembly of FIGS. 1 and 2.
Figure 5:
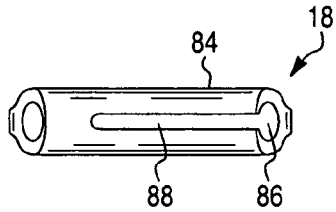
FIG. 5 is a bottom view of the shoulder strap fastener of FIG. 4.
Figure 6:
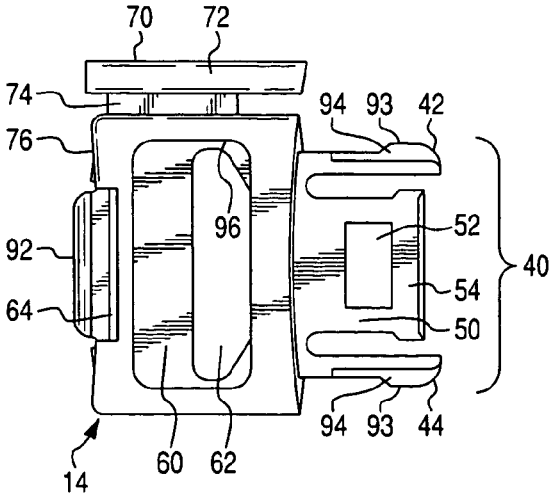
FIG. 6 is a front view of a waist strap fastener of the buckle assembly of FIGS. 1 and 2.

Each of the first and second waist strap fasteners 14, 16 include a fastener coupling section 40 that is configured for coupling with respective openings 38 (see FIG. 3) arranged on opposing sides of the buckle body 12. For simplicity, FIG. 3 shows only one of the openings although there is another opening opposing the one shown in FIG. 3. The fastener coupling section 40 comprises a pair of horizontally extending and parallel guide arms 42, 44 that may be passed into one of the openings 38 as waist strap fastener 14, 16 is pushed into the buckle body 12. The guide arms 42, 44 act to guide the fastener coupling section 40 into the opening 38. In that regard, each of the guide arms 42, 44 comprises a widened portion 93 that contacts a respective of the outer walls 39 of the opening 38 as the fastener coupling section 40 is pushed into the opening 38. Each of the guide arms 42, 44 also includes a recess 94. The buckle body 12 may include a step 37 on one or both the outer walls 39 so that the step 37 passes along and contacts recess 94 of one of the arms 42, 44 to also aid in guiding the arm into the hole 38.

Each of the first and second fastener coupling sections 40 includes an inner portion 50, between the guide arms 42, 44, with a hole 52 configured to engage with an inclined step 36 on an inner wall of the buckle body 12. The height of the inclined step 36 increases with distance into the hole 38. As the coupling section 40 is pushed into the hole 38, a widened portion 54 of the inner portion 50 in front of the hole 52 passes over the inclined step 36 and pushes up an extending portion 35 of the release button 30, where the extending portion 35 extends into the hole 38 through a opening in the buckle body 12. The release button 30 is thus also pushed up. The extending portion 35 correspondingly provides a downward biasing force on the widened portion 54, which is preferably formed of an elastic material, such as an elastic plastic. When the widened portion 54 passes the inclined step 36, the inclined step 36 snaps into the hole 52. The fastener coupling section 40 is thus snapped into the buckle body 12, and the waist strap fastener 14, 16 is thus coupled to the buckle body 12.

Each of the first and second waist strap fasteners 14 and 16 includes a top coupling section 70 that is configured for coupling to respective bottom coupling sections 84 of the respective first and second shoulder strap fasteners 18 and 20. The top coupling section 70 may comprise a side arm 72. Each waist strap fastener 14, 16 also includes a narrowed section 74 as part of a main body 76 of the waist strap fastener 14, 16, separating the respective side arm 72 from the rest of the main body 76. Each of the bottom coupling sections 84 is configured to define a channel 86 and a slot 88 adjacent and parallel to the channel 86. The side arm 72 is configured to be received in channel 86. The side arm 72 can have various cross-sectional shapes, such as generally circular, triangular, or square cross sections, for example, and the channel 86 can have a cross section to match that of the side arm 72.

Each of the waist strap fasteners 14, 16 may be coupled to a respective shoulder strap fastener 18, 20 by coupling a respective top coupling section 70 to a bottom coupling section 84. In this regard, a shoulder strap fastener 18, 20 is slid onto its respective top coupling section 70 such that side arm 72 passes into and along a respective channel 86, and narrowed section 74 passes into and along the respective slot 88. The shoulder strap fastener 18, 20 is slid onto its respective top coupling section 70 until narrowed section 74 encounters the end of slot 88, which serves as a stop. The shoulder strap fastener 18, 20 thus slidingly engages and disengages with its respective waist strap fastener 14, 16. Furthermore, when the first and second waist strap fasteners 14, 16 are coupled to the buckle body 12, the arms 72 are substantially perpendicular to the respective openings 38, and the upper corners of the buckle body 12 trap the shoulder strap fasteners 18, 20 to prevent them from sliding off their respective arms 72, as seen in FIG. 1.

When the components of the buckle assembly 10 are coupled together, such that first and second shoulder strap fasteners 18, 20 are coupled respectively to the first and second waist strap fasteners 14, 16, and the waist strap fasteners 14, 16, are coupled to the buckle body 12, the first and shoulder strap fasteners 18, 20 are spaced or offset from the respective openings of the buckle body 12 and remain exterior of the buckle body 12.

The buckle assembly 10 described above provides a number advantages.

The buckle assembly 10 described above is less susceptible to fouling than conventional five point buckle assemblies. The buckle assembly 10 does not require the buckle body 12 to have a slot or other coupling section for directly coupling the shoulder strap fasteners 18, 20 to the buckle body 12. Buckle body configurations with slots or other shoulder strap coupling sections can become filled with dirt, food particles, or other undesired material. Because buckle body 12 does not include such a slot or shoulder strap coupling section, it does not become fouled or clogged with dirt, food particles, or other undesired material.

Moreover, when the first and second waist strap fasteners 14, 16 are decoupled and separated from the buckle body 12, the first and second shoulder strap fasteners 18, 20, freely and easily separate from the waist strap fasteners 14, 16 in a passive fashion. Thus, when decoupled from the buckle body 12, the shoulder strap fastener 18, 20 and its respective waste strap fastener 14, 16 do not create a closed loop.

In addition, the buckle assembly 10 can be decoupled completely simply by one button activation. When the buckle assembly 10 is in the assembled state with all of the components coupled together, all of the components may be decoupled by merely activating the release button 30. Pressing the release button 30 releases both the first and second waist strap fasteners 14 and 16 from the buckle body 12. The first and second shoulder strap fasteners 18 and 20 then easily slide off of the respective first and second waist strap fasteners 14 and 16.

Further, the buckle assembly 10 can be used either as a five point buckle assembly, employing both shoulder strap fasteners 18, 20 and both waist strap fasteners 14, 16, or as a three point buckle assembly, without employing the first and second shoulder strap fasteners 18, 20, depending on the context. The buckle assembly 10 thus provides flexibility in its use.

Finally, when the buckle components are coupled, the buckle assembly 10 maintains the shoulder strap fasteners 18, 20 in a substantially horizontal orientation relative to the buckle body 12 and adjacent to a top end of the waist strap fasteners 14, 16, rather than in vertical orientation sandwiched between the waist strap fasteners 14, 16 and the buckle body 12. This orientation of the shoulder strap fasteners 18, 20 minimizes the overall buckle size and improves the aesthetics when the buckle assembly 10 is used as a three point buckle assembly.

The preferred embodiments have been set forth herein for the purpose of illustration. This description, however, should riot be deemed to be a limitation on the scope of the invention. Various modifications, adaptations, and alternatives may occur to one skilled in the art without departing from the claimed inventive concept. The true scope and spirit of the invention are indicated by the following claims.

What is claimed is:

1. A buckle assembly comprising:

a buckle body having first and second openings;

first and second waist strap fasteners having first and second fastener coupling sections, respectively, configured for respectively coupling with the first and second openings, and having respective top coupling sections; and first and second shoulder strap fasteners having respective bottom coupling sections configured for coupling to respective of the top coupling sections to couple fixedly the first waist strap fastener to the first shoulder strap fastener and the second waist strap fastener to the second shoulder strap fastener, wherein each top coupling section comprises an arm perpendicular to a respective opening of the openings when the first and second waist strap fasteners are coupled to the buckle body.

2. The buckle assembly of claim 1, wherein each bottom coupling section comprises a channel configured for receiving a respective one of the arms.

3. The buckle assembly of claim 2, wherein each waist strap fastener comprises a main body and a narrowed section between a respective arm of the waist strap fastener and the main body, and wherein each bottom coupling portion includes a slot configured for receiving a respective narrowed section.

4. The buckle assembly of claim 1, wherein the fastener coupling sections each comprise a pair of guide arms and an inner portion between the top and bottom guide arms.

5. The buckle assembly of claim 1, wherein the buckle body comprises a release button configured for releasing, when pressed, the first and second waist strap fasteners from the buckle body.

6. The buckle assembly of claim 1, wherein when each waist strap fastener is coupled with its respective shoulder strap fastener, and when each waist strap fastener is coupled to the buckle body, the arms remain exterior to the buckle body.

7. The buckle assembly of claim 1, wherein each waist strap fastener is configured to slidingly engage and disengage with its respective shoulder strap fastener.

8. The buckle assembly of claim 7, wherein when the first and second shoulder strap fasteners are coupled to the first and second waist strap fasteners, respectively, and the buckle body is coupled to the first and second waist strap fasteners, the buckle body prevents the first and second shoulder strap fasteners from being decoupled, respectively, from the first and second waist strap fasteners.

9. A buckle assembly comprising:

a buckle body having first and second openings;

first and second waist strap fasteners, each having a fastener coupling section configured to couple to the respective openings of the buckle body, each also having a shoulder strap coupling section; and first and second shoulder strap fasteners, each having a waist strap fastener coupling section configured for fixedly coupling to the shoulder strap coupling section of the respective waist strap fastener, wherein the respective shoulder strap coupling sections and the respective waist strap coupling sections are arranged relative to each other such that, when the first and second shoulder strap fasteners are coupled to the first and second waist strap fasteners, respectively, and the buckle body is coupled to the first and second waist strap fasteners, the first and second shoulder strap fasteners are spaced from the respective openings of the buckle body and remain exterior of the buckle body.

10. The buckle assembly of claim 9, wherein when the first and second shoulder strap fasteners are coupled to the first and second waist strap fasteners, respectively, and the buckle body is coupled to the first and second waist strap fasteners, the buckle body prevents the first and second shoulder strap fasteners from being decoupled, respectively, from the first and second waist strap fasteners.

11. The buckle assembly of claim 9, wherein, when the first and second waist strap fasteners are decoupled from the buckle body, the first and second shoulder strap fasteners passively decouple from the first and second waist strap fasteners, respectively.

* * * * *